US005934059A

United States Patent [19]

Langen

[11] Patent Number: 5,934,059

[45] Date of Patent: Aug. 10, 1999

[54] MANIPULATING DEVICE ON A CAN CHANGING CARRIAGE OF A SPINNING MACHINE

[76] Inventor: Manfred Langen, SchulstraBe 58, D41065, Monchengladbach, Germany

[21] Appl. No.: 09/053,991

[22] Filed: Apr. 2, 1998

Related U.S. Application Data

[30] Foreign Application Priority Data

Apr. 4, 1997 [DE] Germany ..... 197 13 905
May 23, 1997 [DE] Germany ..... 197 21 640

[51] Int. Cl.[6] ..... D01H 9/10

[52] U.S. Cl. ..... 57/281; 19/159 A; 57/268

[58] Field of Search ..... 19/159, 90; 57/281, 57/268

[56] References Cited

U.S. PATENT DOCUMENTS 4,042,093 8/1977 Fujii et al. ..... 19/159 A
5,511,372 4/1996 Leidgens ..... 57/281
5,535,581 7/1996 Tahara et al. ..... 57/281
5,560,179 10/1996 Leifeld ..... 19/159 A
5,634,316 6/1997 Leifeld ..... 19/159 A

FOREIGN PATENT DOCUMENTS 40 15938A1 11/1991 Germany .
43 33 775A1 7/1994 Germany .

*Primary Examiner*—William Stryjewski
*Attorney, Agent, or Firm*—Kennedy Covington Lobdell & Hickman, L.L.P.

[57] ABSTRACT

A manipulating device for can changing between a can changing carriage and a row of payout cans in a spinning machine is described for the case where rectangular cans are used. To automate the transfer of the cans without substantially increasing the expense for space in the region of the carriage compared with the case of manual transfer, and without having to engage an empty can, which is to be pulled out of a row of cans, from behind or beneath the can, a substantially one-piece can carrier is provided, which is supported displaceably, crosswise to the carriage travel direction, in a rail guide on the carriage and which on each of its longitudinal ends has a preferably pivotably supported gripper, each for coupling to one short side of the cans.

8 Claims, 2 Drawing Sheets

1
2
3
4
5
6
7
8
9
10
11
12
13
14
15
21
22
23
24
25
26
27
28
29
30
31
a
B
L

MANIPULATING DEVICE ON A CAN CHANGING CARRIAGE OF A SPINNING MACHINE

FIELD OF THE INVENTION

The invention relates to a manipulating device on a can changing carriage of a spinning machine for transferring rectangular cans from a payout position of the spinning machine to a storage space of the carriage or vice versa, wherein the carriage is movable along a transport course along the front of the row of rectangular cans being paid out at the machine, and the rectangular cans of the row of cans stand with the short side of the rectangle approximately parallel to the transport course.

BACKGROUND OF THE INVENTION

In the textile industry, slivers or rovings are transported from and to drawframes, as well as fliers and spinning machines, in so-called spinning cans. After being filled or having run empty, each can must be replaced with a new empty or filled can as applicable. Optionally, the cans can be pulled or pushed singly or in groups on roller or sliding guides.

Modern spinning machines are supplied with the roving in so-called rectangular cans. These cans have standardized sizes and in principle a parallelepiped shape. They are positioned with their broad sides of the rectangles facing one another beneath the spinning stations or spindles of a spinning machine. In this so-called payout position, the roving, prepared to suit the applicable spinning process, is drawn out of a can at each spinning station. Once a can has run empty, it is replaced with a new full can. Since the cans are in self-contained rows side by side below the spinning stations, an empty can is first pulled out of the row and then replaced with a fill can.

For transporting the cans to and from the spinning stations, so-called can changing carriages are used. A can changing carriage retrieves and brings only as many full and empty cans each as it has a free space for at any time. This is necessary because on changing cans at the spinning machine, it must first take away an empty can (to create space for a full can) before it can place a full can in a payout position of the spinning machine.

The can changing carriage travels on a drive track, along the row of cans to be served, usually between two rows of spinning machines. It should not be substantially wider—measured crosswise to the drive track—than the can length; can length means the longest side of the rectangle, measured parallel to the can bottom, while can width is the length of the shortest side of the rectangle, measured parallel to the can bottom. The can changing carriage can have a width equal to the can length, if it is intended to hold and transport the cans in the same orientation (crosswise to the drive track) as that in which they stand in the can row in the payout position. However, the carriage should not be substantially wider than the can length, because otherwise the spacing from one spinning machine to another or one row of cans to another in adjacent rows of spinning machines would have to be correspondingly greater. Conventionally, can changing has been done manually, since the free space along the travel path of the can changing carriage has not seemed to afford enough space for mechanical apparatus and gripper, there not being sufficient space to insert grippers between the cans, which are packed flush with one another in a row.

In German Patent Disclosure DE 40 15 938 A1, a special short side can construction is made a prerequisite; on one long end, it has a lever with a sliver guide. The lever is secured to a short side of the can with the aid of a rod. Each can can be pulled out of its position below the spinning machine by being grasped by the rod. To that end, a can manipulator that contains a telescope is provided, which with the aid of a slide encompasses and by a single telescoping motion pulls it onto the vehicle away from the central plane of the spinning machine.

Accordingly, the prior art discloses a kind of trolley, which can be moved toward the applicable can with the aid of a telescope. A lifting device with a (single) horizontal gripper is secured to this trolley. For operation, four different drive mechanisms are necessary, namely drive mechanisms for the telescope, the trolley, a turning cylinder, and a lifting cylinder.

Another disadvantage of the arrangement described in the aforementioned reference DE 40 15 938 A1 is that with the manipulator, the applicable can can be unloaded only from the same side of the carriage as that which had received it in the first place. As a consequence of the known arrangement, the can is "lifted", since the single gripper seated on its trolley engages it from below. Hence the gripper cannot move past the can that has been placed on the carriage, and therefore it can remove the can only from the same side of the carriage by way of which it had loaded the can initially.

In German Patent Disclosure DE 43 33 775, a pivotable gripper is described that at the same time can advance two round cans, one empty and one full can, that are standing below the sliver depositor of a drawframe, by one can width fast enough that the sliver being paid out is not interrupted. This reference indeed has two grippers, but the two grippers are always in use simultaneously, so that in the final analysis, only one gripper for each can is available.

OBJECT AND SUMMARY OF THE INVENTION

The object of the invention is to create an automatic manipulating device for replacing rectangular cans between a spinning machine and a can changing carriage, in which empty rectangular cans are first to be taken out of the grouping below the spinning machine and are then to be placed on the carriage, or full cans are conveyed in the opposite direction. When the cans are taken out of the row of cans under the spinning machine, or when they are placed in the row of cans, there is no need for grippers to engage the bottom of the cans or to reach laterally between the cans or above the can in the longitudinal direction.

The preferred embodiment relates to a manipulating device on a can changing carriage of a spinning machine for transferring rectangular cans from a payout position of the spinning machine to a storage space of the carriage and vice versa, wherein the carriage is movable along a transport path along the front of the row of rectangular cans being paid out at the machine, and moreover the rectangular cans of the row of cans stand with the short side of the rectangle approximately parallel to the transport path.

According to the invention, a substantially one-piece, elongated can carrier, a kind of "push-and-pull rod", is supported in a rail guide on the can changing carriage so as to be displaceable crosswise to the transport path, which on its longitudinal ends has one pivotably mounted gripper each for coupling the short side of the cans.

According to the invention, for transferring the respective rectangular can, a can carrier acting like a one- piece push-and-pull rod is provided, which has one horizontally movable gripper on each of its longitudinal ends. For operating the apparatus, accordingly instead of four drive mechanisms as in DE 40 15 938 A1, only three drive mechanisms are now needed, namely one drive mechanism for the can carrier and one drive mechanism each for the two grippers.

Since the two grippers of the can carrier of the invention are secured individually pivotably to the longitudinal ends of the carrier, they can be hinged upward independently and moved past the can located on the carriage when in a retracted position. They therefore make it possible for one and the same can on the carriage to be received or removed on either the left or the right, selectively.

In other words by the present invention the individual spinning cans are first pulled partially out of a row of cans, with the aid of one gripper, and then pulled fully onto the respective carriage with the aid of the other gripper. When being set down from the carriage and pushed into the row of cans, then successively the order is reversed, first one and then the other gripper of the carrier is used. The grippers are seated so as to be pivotable independently of one another on the longitudinal ends of the can carrier.

The grippers of the can carrier of the invention can be embodied in an arbitrary way such that they are capable of grasping a can, in an automatic operation, on its short side toward the carriage, such that the can can be pulled onto the carriage, via its longitudinal edge, with the aid of the gripper or pushed off the carriage into a row of payout cans.

To that end, the grippers may be equipped with hooks for catching in a can handle, with suction devices, with clamping means, and similar retaining means. If one gripper interferes spatially with the work of the other gripper, then it is highly advantageous to embody the mechanics such that whichever gripper is inactive can be moved or pivoted into a retracted position on the carrier in which it does not interfere with the can being manipulated by the other gripper and a retracted gripper can be below a can that is in transport position on the carriage.

The can carrier of the invention preferably includes an elongated carrier body, acting as one part during operation, with grippers mounted generally movably on its longitudinal ends. The carrier body should among other things be supported movably in the carrier guide crosswise to the transport path on the can changing carriage in such a way that in its work, while it does reach as far as the short side toward it of a can to be pulled out of position, nevertheless on its return it does not strike the opposite row of cans and so forth. The spacing of the two grippers is therefore generally markedly shorter than the can length. Since the carrier body can accordingly not be longer than the width of the carriage, and the carriage width should be only approximately the same length as the can length, the carrier moved outward in the direction of the row of cans still does not reach as far as the short side of the cans toward the rear facing whichever can is to be pulled out behind the carriage. For this reason, according to the invention, for transferring a can from a payout row of the spinning machine to the can changing carriage, the following phases are provided:

First phase: Basic position of the can carrier approximately symmetrically in the middle on the carriage.

Second phase: Movement outward of the can carrier toward a payout row, so that the front gripper, toward the row of cans, can be coupled to the front short side of the can oriented toward the carriage or its longitudinal edge.

Third phase: Moving the can carrier in its guide past the middle of the carriage, so that the can is partly pulled, for instance by its front short side, to nearly the middle of the carriage.

Fourth phase: Release of the front gripper from the front short side and optional pivoting of this gripper outward, so that it does not interfere with further reverse motions of the carrier, so that, with the other, rear gripper brought into the coupling position, it can be coupled to the front short side of the can already located on the carriage.

Fifth phase: Switchover of carrier motion again, so that the can, with the aid of the rear gripper, can be pulled entirely onto the carriage, approximately in the middle.

Sixth phase: Release of the rear gripper and movement of the can carrier to its initial position.

It is attained by means of the invention that a can carrier functioning as one part during operation, which on its longitudinal ends has movable grippers for coupling a short side of the cans and which overall has a length markedly less than the width of the carriage, is capable of pulling one can out of the front, facing the longitudinal edge of the carriage of a row of cans packed flush with one another and putting it on the carriage. Hence there is no need for the manipulating device to grasp the can by its bottom or sides or its rear short side, all of which are not easily accessible, because it has two grippers that can be brought successively into engagement with the front short side of cans. These grippers preferably have a spacing of at least approximately twice the size of the spacing between the longitudinal edge of the carriage and the front of the row of cans being manipulated. The grippers are secured, preferably movably, to the longitudinal ends of a carrier that is movable on the carriage crosswise to the transport path.

In general, it takes less effort to set down a full can at a space in the row that is free once an empty can has been removed, but in principle the same phases as given above can be employed but in reverse order.

In accordance with a further feature of the invention, the manipulating device can be used not only with a can changing carriage to be assigned to a row of payout cans of the spinning machine in the narrower sense, but also in general with a can changing carriage which takes cans from and/or furnishes cans to a can storage apparatus.

It is therefore also possible within the scope of the invention to assign one and the same can changing carriage both to the spinning machine in the narrower sense and to a can storage system provided for instance between the drawframe and the spinning machine. This is due to the fact that the can changing carriage assigned to a spinning machine itself is intended to take its new full cans and furnish its empty cans to a can storage system automatically.

If this kind of universal can changing carriage is to be used not only at the spinning machine itself but also at other stations in the spinning mill between the drawframe and the spinning machine, then it is often desirable for four or more cans at a time to be set down or picked up in a storage system. In this or similar cases, the manipulating device of the invention can be equipped with a can carrier that has a double gripper on each longitudinal end. In accordance with a further feature of the invention, such a double gripper may comprise two single grippers of the aforementioned type, which face one another on each of the ends of the carrier and are preferably to be actuated independently of one another, to enable corresponding universal application of the apparatus. Alternatively, a double gripper is provided that is capable of grasping two or more cans at once. The first alternative involves a two- armed double gripper, and the other involves a one-armed double gripper.

Optionally, a can carrier can move two cans at once with the aid of the two- or one-armed double gripper. If a can changing carriage is to transport four or more cans at once, for instance, then it is also possible to install two manipulating devices according to the invention, each with one can carrier, on the carriage; in that case, each can carrier can have one double gripper, of one type or the other, on each longitudinal end. With a manipulating device equipped in this way, it is easily possible for four or more cans at once to be set in a storage system from the carriage or placed onto the carriage from a storage system.

Details of the invention will be described below in conjunction with the schematic drawings.

DESCRIPTION OF THE PREFERRED EMBODIMENT

Figures 1, 2, 3, 4:
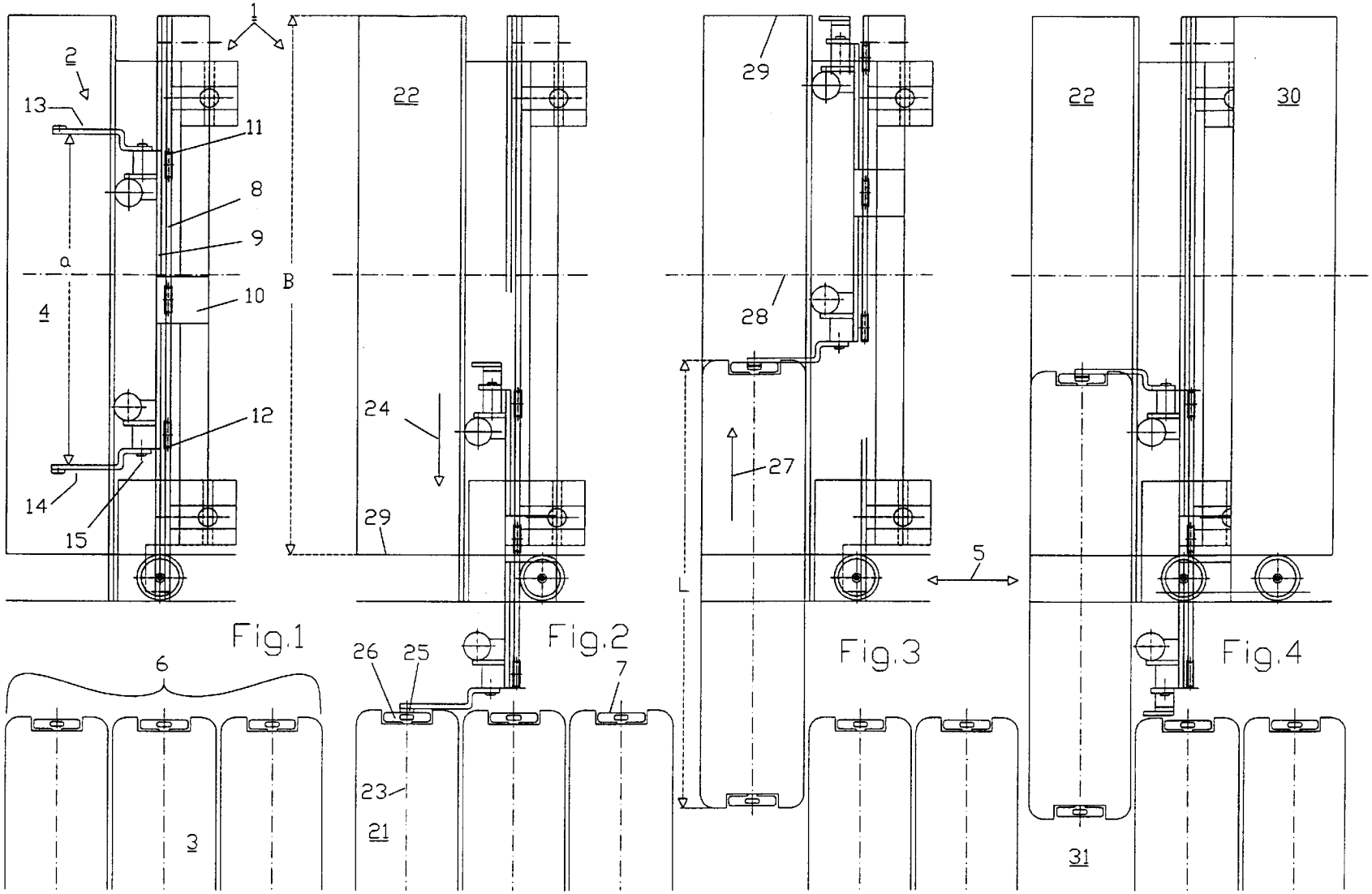
FIGS. 1–4 are plan views of a manipulating device of the preferred embodiment of the present invention illustrating the transfer of a can from a row of payout cans to a can changing carriage.

In FIGS. 1–4, part of a can changing carriage 1 is shown, with a manipulating device identified overall by reference numeral 2 mounted on it. The manipulating device is used to bring rectangular cans 3 from a payout position of a spinning machine (not shown) to a storage place 4 on the carriage 1, or vice versa. The carriage 1 is movable along a transport path 5 along a row 6 of rectangular cans 3 that pay out at the spinning machine. The rectangular cans 3 of the row 6 of cans have their short side 7 of the rectangle approximately parallel to the transport path 5.

The manipulating device 2 according to the invention, includes a rail guide 8, which is mounted on the carriage 1 in a direction crosswise to the direction of the transport path 5. A can carrier designated overall by reference numeral 9 is provided, supported displaceably in the transverse direction on the rail guide 8. The can carrier extends in its longitudinal direction on both sides of a slide body 10, substantially in one part, again crosswise to the direction of the transport path 5. On both of its longitudinal ends 11 and 12, a respective gripper 13 and 14 is pivotably secured, in the exemplary embodiment about an axis 15 that is parallel to the longitudinal extent of the carrier 9. The spacing "a" between the two grippers 13 and 14 should be less than the carriage width "B" measured crosswise to the direction of the transport path 5. Within the scope of the invention, the spacing "a" may be markedly shorter than the can length "L".

When the carriage 1 moves, the can carrier 9 should be in the retracted position shown in FIG. 1. Once a can has run empty in a row 6 of cans, the carriage is driven to this empty can 21 in such a way that an empty space 22 on the carriage 1 is aligned with the longitudinal direction 23 of the cans. The can carrier 9 is thereupon moved in the advancement direction 24 toward the empty can 12 in such a way that the front gripper 13, oriented toward the can 21, of the can carrier 9 can be coupled to that can. In the exemplary embodiment, a hook 25 on the gripper 13 is provided as the coupling means and engages a handle 26 of the can 21. In this procedure, the other gripper 14 can be inactivated for instance being pivoted upward vertically to the plane of the drawing.

In the next phase, the empty can 21, as shown in FIG. 3, is pulled partway onto the carriage 1, for instance to nearly the center line 28 of the carriage, by the motion of the can carrier 9 in the displacement direction 27. In general terms, the empty can 21 is moved onto the carriage 1 far enough that the inactivated, other gripper 14 of the can carrier 9 is still, just barely, not past the longitudinal edge of the carriage opposite the particular row 6 of cans being serviced at the moment, that is, not past the carriage edge 29, at least in any way that it would interfere with an adjacent spinning machine on the opposite side of the path. However, the spacing of the grippers 13, 14 should be at least twice as great as the operational spacing between the carriage edge 29 and the front of the two of cans facing toward the carriage. "Operational spacing" means the actual spacing range occurring during operation between the longitudinal edge of the carriage and the front of the cans.

In the next phase, the front gripper 13 is released from its coupling to the empty can 21 and it is inactivated by being pivoted upward to a retracted position. At the same time, the other gripper 14, which originally faced away from the can 21, is pivoted into the active position, that is, into the plane of the drawing, and the can carrier 9 is moved back to the row 6 of cans in the direction 24, so that the row of cans itself is just barely not contacted by the carrier or the front gripper 13 thereof. In this position, the rear gripper 14 engages the can handle 26 in hooklike fashion. After that, the can carrier 9 is moved back in the direction 27 again, so that finally (not shown), the can is located centrally in the empty space 22 of the machine.

With the aid of the same can carrier 9 and its grippers 13, 14, a full can 30 standing on the carriage 1 can be pushed to the empty place 31 created in the row 6, once the carriage 1 is suitably placed and the can carrier 9 has been switched over. An example of a carriage with a full can 30 set on it is schematically shown in FIG. 4.

Figure 5:
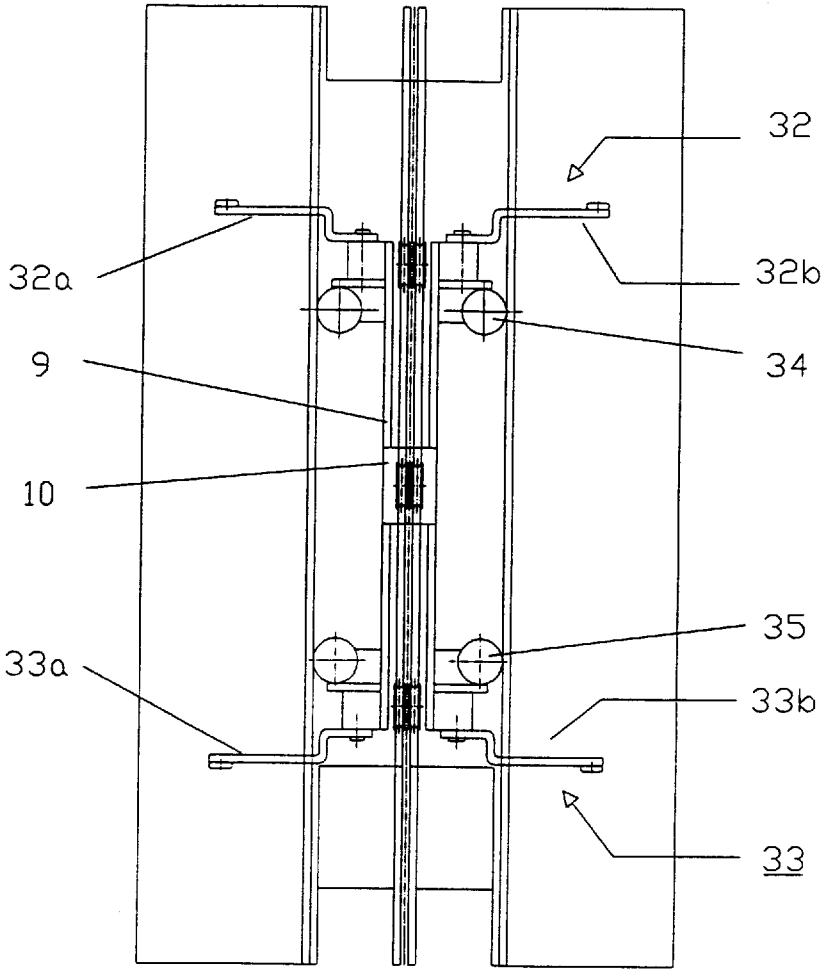
FIG. 5 is a plan view of a device similar to that illustrated in FIGS. 1–4 modified to have a two-armed double gripper.

FIG. 5 shows a modified embodiment according to the invention of a can carrier 9, which has one two-armed double gripper 32, 33 on each of its longitudinal ends 11, 12 on both sides of the slide body 10. Each of the two-armed double grippers 32, 33 includes two single grippers 32*a*, 32*b* and 33*a*, 33*b*, which may be embodied like the grippers 13, 14 of FIGS. 1–4 and/or be equipped with a common drive mechanism 34 and 35 on the longitudinal end 11 and 12, respectively for manipulating two cans at a time.

Figure 6:
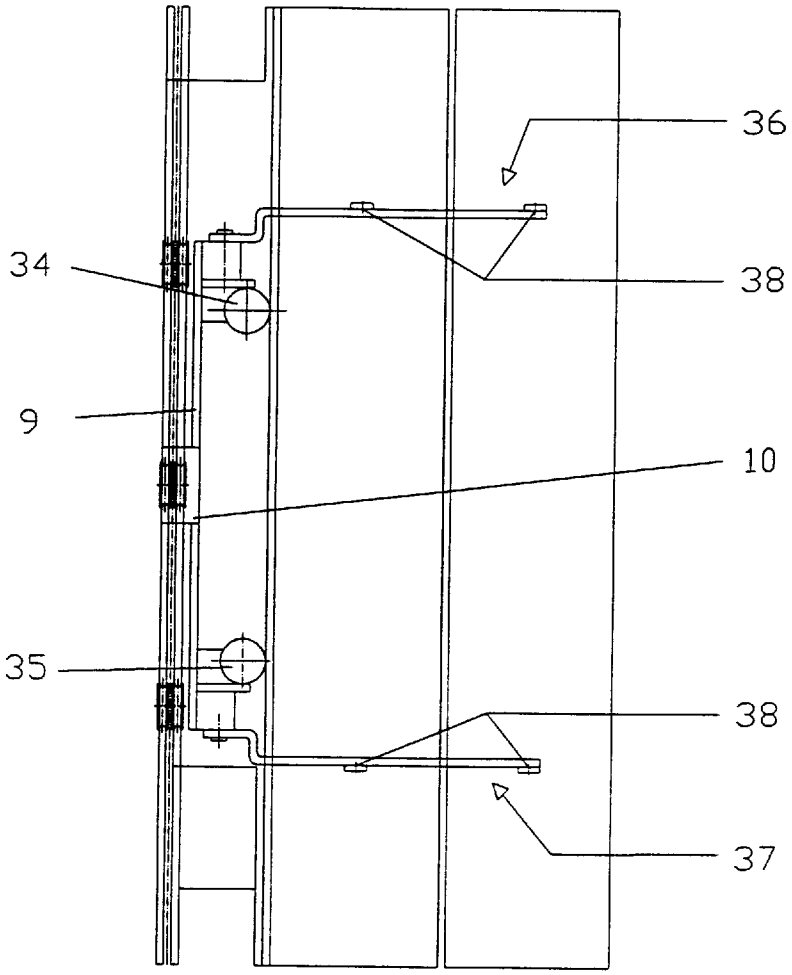
FIG. 6 is a plan view of a device similar to that illustrated in FIGS. 1–4 modified to have a one-armed double gripper.

FIG. 6 shows a modified embodiment according to the invention of a can carrier 9, which, for instance on its longitudinal ends 11, 12 on both sides of the slide body 10, has one one-armed double gripper 36, 37 each for manipulating two cans at a time. The one-armed "double gripper" can in principle also grasp more than two cans at once, if its arms are suitably long and if each arm has suitable clamping means 38. One advantage over the two-armed double gripper (FIG. 5) is that the production cost is relatively low. The two-armed double gripper 32, 33, however, can be embodied with single grippers 32*a* and 32*b* to be actuated independently of one another and as a result can be designed relatively flexibly. In principle, the embodiments of FIGS. 5 and 6 can also be combined, so that the two-armed double gripper 32 or 33 of FIG. 5 grasps two or more cans on each arm.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A manipulating device on a can changing carriage of a spinning machine for transferring rectangular cans from a payout position of the spinning machine to a storage space of the carriage and vice versa, wherein the carriage is movable along a transport path along the front of the row of rectangular cans being paid out at the machine, and the rectangular cans of the row of cans stand with the short side of the rectangle approximately parallel to the transport path, comprising, a substantially one-piece, elongated can carrier, supported in a rail guide on the can changing carriage so as to be displaceable crosswise to the transport path and a gripper pivotably mounted to each of the longitudinal ends of the can carrier, for coupling to a short side of the cans.

2. The manipulating device of claim 1, characterized in that said grippers are pivotable about axes that are oriented approximately parallel to the longitudinal direction of the cans carrier.

3. The manipulating device of claim 1, characterized in that the spacing of the grippers, mounted on the longitudinal ends of the carrier, is less than the length of the long side of the rectangle of the cans to be transferred.

4. The manipulating device of claim 3, characterized in that said mutual spacing of the grippers is at least twice as great as the operational spacing between longitudinal edge of the carriage, and the front of the row of cans oriented toward the carriage.

5. The manipulating device of claim 1, characterized in that said grippers provided on the longitudinal ends of the carrier are double grippers.

6. The manipulating device of claim 5, characterized in that said grippers are two-armed double grippers.

7. The manipulating device of claim 6, characterized in that each of the two-armed double grippers comprises two single grippers to be actuated independently.

8. The manipulating device of claim 5, characterized in that said grippers are one-armed double grippers.

* * * * *